US008571226B2

(12) United States Patent
Isberg

(10) Patent No.: US 8,571,226 B2
(45) Date of Patent: Oct. 29, 2013

(54) AUTOMATIC POLARITY ADAPTATION FOR AMBIENT NOISE CANCELLATION

(75) Inventor: Peter Isberg, Lund (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 384 days.

(21) Appl. No.: 12/964,859

(22) Filed: Dec. 10, 2010

(65) Prior Publication Data

US 2012/0148060 A1 Jun. 14, 2012

(51) Int. Cl.
*G10K 11/16* (2006.01)

(52) U.S. Cl.
USPC ..... 381/71.1; 381/71.12; 381/58; 381/59; 381/123; 381/96; 381/107; 381/97; 381/98; 381/104; 704/220; 704/221; 704/222; 704/223; 704/224; 700/94

(58) Field of Classification Search
USPC ..... 381/71.1, 71.12, 58, 59, 123, 96, 107, 381/97, 98, 104; 704/220–226; 700/94
See application file for complete search history.

(56) References Cited

U.S. PATENT DOCUMENTS 5,426,703 A 6/1995 Hamabe et al.
5,748,725 A * 5/1998 Kubo ..... 379/392.01
5,909,496 A * 6/1999 Kishigami et al. ..... 381/111
2007/0217619 A1* 9/2007 Hall et al. ..... 381/59
2009/0262951 A1 10/2009 Togawa et al.
2010/0067712 A1* 3/2010 Maeda ..... 381/66
2010/0166206 A1* 7/2010 Macours ..... 381/71.6
2010/0226505 A1 9/2010 Kimura
2011/0007907 A1* 1/2011 Park et al. ..... 381/71.8
2013/0034236 A1* 2/2013 Hung et al. ..... 381/71.1

FOREIGN PATENT DOCUMENTS

WO 03/030145 A1 4/2003

OTHER PUBLICATIONS

International Search Report, corresponding to PCT/EP2011/005458, mailed Jul. 12, 2012.
Written Opinion of the International Searching Authority, corresponding to PCT/EP2011/005458, mailed Jul. 12, 2012.

* cited by examiner

*Primary Examiner* — Mohammad Islam
*Assistant Examiner* — Kuassi Ganmavo
(74) *Attorney, Agent, or Firm* — Renner, Otto, Boisselle, Sklar, LLP

(57) ABSTRACT

A sound reproducing device has a loudspeaker arranged to produce sound from an audio signal provided by an audio signal source. A microphone is positioned to pick up ambient noise and generate a microphone signal which comprises the noise. An ambient noise cancellation (ANC) system receives the microphone signal from the microphone and generates anti-noise corresponding to the ambient noise in the microphone signal. An automatic polarity adaptation (AAP) system monitors the ANC system and, when a decision criterion is fulfilled, causes a switch in polarity for the generated anti-noise.

7 Claims, 5 Drawing Sheets

Feed-back ambient noise cancellation with automatic polarity adaption (APP)

Feed-back
ambient noise cancellation
with automatic polarity
adaption (APP)

Feed-back
ambient noise cancellation
with automatic polarity
adaption (APP)

Feed-forward
ambient noise cancellation
with automatic polarity
adaption (APP)

Ambient noise cancellation (ANC)
with automatic polarity adaption (APP):

AUTOMATIC POLARITY ADAPTATION FOR AMBIENT NOISE CANCELLATION

TECHNICAL FIELD

The present invention relates to the field of sound reproducing equipment, and more specifically sound reproducing devices of the type having a loudspeaker, a microphone positioned to pick up ambient noise and generate a microphone signal comprising the noise, and an ambient noise cancellation (ANC) system coupled to receive the microphone signal from the microphone and to generate anti-noise corresponding to the ambient noise therein. The present invention also relates to a portable communication apparatus, and to an ambient noise cancellation method.

BACKGROUND

Sound reproducing equipment of course exists in many different types. One common example is stereo headphones which allow a user to enjoy music, radio broadcast or TV shows in a private manner without having to pay attention to other people's preferences when it comes to sound source, sound volume, etc.

To reduce disturbances from ambient noise sources, sound reproducing devices, such as stereo headphones, are sometimes provided with an "ambient noise cancellation" system, or "automatic noise cancellation" system, often abbreviated ANC. One or more microphones in the ANC system pick up the surrounding noise, and the ANC system causes one or more loudspeaker to play "anti-noise" in the ears of the user. This results in a lower noise level at the ear drums of the user.

ANC systems can be of "feed-forward" or "feed-back" types, or combinations thereof. As seen in FIG. 3*a*, a feed-back ANC system 300 is used in a scenario where at least one loudspeaker 302 is arranged to produce sound from an audio signal 301. The produced sound is to be perceived by the ear 11 of a user 10. The feed-back ANC system 300 uses at least one microphone 304 positioned more or less inside the ear 11 (typically, inside or close to the concha cavity of the outer ear). The microphone 304 senses the sum of the surrounding (ambient) noise and the anti-noise and produces a microphone signal 305 which includes these contents. Signal processing means 306, such as one or more signal filters, processes the microphone signal 305 and acts to provide an anti-noise output signal 307 which will counteract the ambient noise. The anti-noise output signal 307 is added at 308 to the audio signal 301 being fed to the loudspeaker 302, and the feedback loop thus formed will, over time, cancel as much as possible of the ambient noise.

It is to be noticed that the layout in FIG. 3*a* is schematic and does not show all possible elements of a real-life implementation of a feed-back ANC system. For instance, the audio signal components of the microphone signal 305 are typically removed prior to the signal processing means' 306 generation of the anti-noise output signal 307. Such removal may be done by functionality in the signal processing means 306 itself (having access to the audio signal 301, as seen at 301'), or by separate functionality not shown in the drawing. As is well known in the field of feed-back ANC systems, removal of the audio signal components from the microphone signal 305 may involve, for instance, the use of a least-mean-square (LMS) optimized filter together with other fixed or adaptive filters in order to account for the fixed or varying transfer function of the electro-acoustic system which includes the loudspeaker 302.

Feed-forward systems use microphone(s) outside of the ear which sense(s) only the surrounding noise. See microphone 304 in FIG. 3*b*. Both topologies are used commercially with various pros and cons. The anti-noise, i.e. signal 307, must be played with reversed polarity compared to the surrounding noise in order to obtain any cancellation effect. If the polarity is incorrect, the result will be more noise rather than less.

An upcoming trend is ANC in handset mode for mobile phones. The principle is the same but the anti-noise is now played by the ear speaker of the mobile phone. The effect is only perceived in one ear, and the lower frequencies are typically not possible to cancel. Nevertheless, products on the market already use this functionality. Microphones are manufactured and mounted with consistent polarity to work as intended. However, ear speakers are not always guaranteed to have consistent polarity. Furthermore, they may be mechanically designed to be rotation symmetric, which means they may fit the phone in more than one way. In order to use an ear speaker for ANC, the component manufacturer must guarantee a consistent polarity and the mobile phone assembly must be secured. This may mean that components need to have guiding pins or similar that makes incorrect mounting impossible. Off-the-shelf components may not be possible to use.

SUMMARY

An object of the invention is to avoid, eliminate or at least reduce one or more of the problems referred to above with respect to sound reproducing devices which have an ambient noise cancellation (ANC) system.

As a conceptual understanding behind the invention, it has been realized that the sound reproducing device shall be provided with means for automatically adapting the polarity of the anti-noise, such that the effect of the generated anti-noise when it comes to obtaining noise cancellation can be detected and the polarity of the anti-noise signal from the ANC system can be reversed, if need be.

Based on this conceptual understanding, the invention has been reduced to practice at least according to the aspects and embodiments of the invention referred to below.

One aspect of the present invention therefore is a sound reproducing device having a loudspeaker arranged to produce sound from an audio signal provided by an audio signal source; a microphone positioned to pick up ambient noise and generate a microphone signal comprising said noise; an ambient noise cancellation (ANC) system arranged to receive the microphone signal from said microphone and to generate anti-noise corresponding to the ambient noise in said microphone signal; and an automatic polarity adaptation (AAP) system arranged to monitor said ANC system and, when a decision criterion is fulfilled, to cause a switch in polarity for the generated anti-noise.

In one embodiment, the AAP system is arranged to monitor the ANC system by monitoring said microphone signal, wherein said decision criterion is that the sum of the ambient noise and the generated anti-noise in said microphone signal exceeds a predetermined limit.

In one embodiment, in which the ANC system comprises at least one signal filter and is arranged to perform a feedback loop adaptation process in which filter parameters of said signal filter are adapted in order to minimize the sum of the ambient noise and the generated anti-noise in said microphone signal, the decision criterion is that the feedback loop adaptation process does not converge as expected.

The AAP system may be further arranged, when said decision criterion is fulfilled, to store information in a memory, said stored information indicating that the loudspeaker is mounted with a reversed polarity which requires a switch in polarity for the generated anti-noise in order for said ANC system to work properly. At least one of the AAP system or the ANC system is advantageously further arranged to use the information stored in said memory in the future for causing said switch in polarity based on said stored information.

In one embodiment, in which the generated anti-noise is added to the audio signal provided by said audio signal source to form a resulting audio signal which is fed to said loudspeaker, the AAP system is arranged to cause said switch in polarity for the generated anti-noise by reversing the polarity of said resulting audio signal.

In one embodiment, the AAP system comprises control means coupled to monitor said ANC system; switch means coupled to be controllable by said control means and having an output coupled to said loudspeaker; and inverter means coupled to receive said resulting audio signal and having an output coupled to an input of said switch means. The control means is arranged, when said decision criterion is fulfilled, to issue a command or control signal to said switch means to enable said switch means to reverse the polarity of said resulting audio signal and deliver it to said loudspeaker.

A second aspect of the invention is a portable communication apparatus which comprises a sound reproducing device in accordance with the first aspect of the invention, or any of its embodiments. The portable communication apparatus may advantageously be a mobile terminal, such as a mobile phone for a mobile tele-communications system like GSM, UMTS, D-AMPS, CDMA2000, FOMA or TD-SCDMA.

A third aspect of the invention is an ambient noise cancellation method, which involves picking up ambient noise to generate a microphone signal; providing ambient noise cancellation (ANC) to generate anti-noise corresponding to the ambient noise in said microphone signal; monitoring the ambient noise cancellation; determining that a decision criterion is fulfilled; and causing a switch in polarity for the generated anti-noise.

It should be emphasized that the term "comprises/comprising" when used in this specification is taken to specify the presence of stated features, integers, steps, or components, but does not preclude the presence or addition of one or more other features, integers, steps, components, or groups thereof.

BRIEF DESCRIPTION OF THE DRAWINGS

Objects, features and advantages of embodiments of the invention will appear from the following detailed description, reference being made to the accompanying drawings, in which.

DETAILED DESCRIPTION

Figure 1:
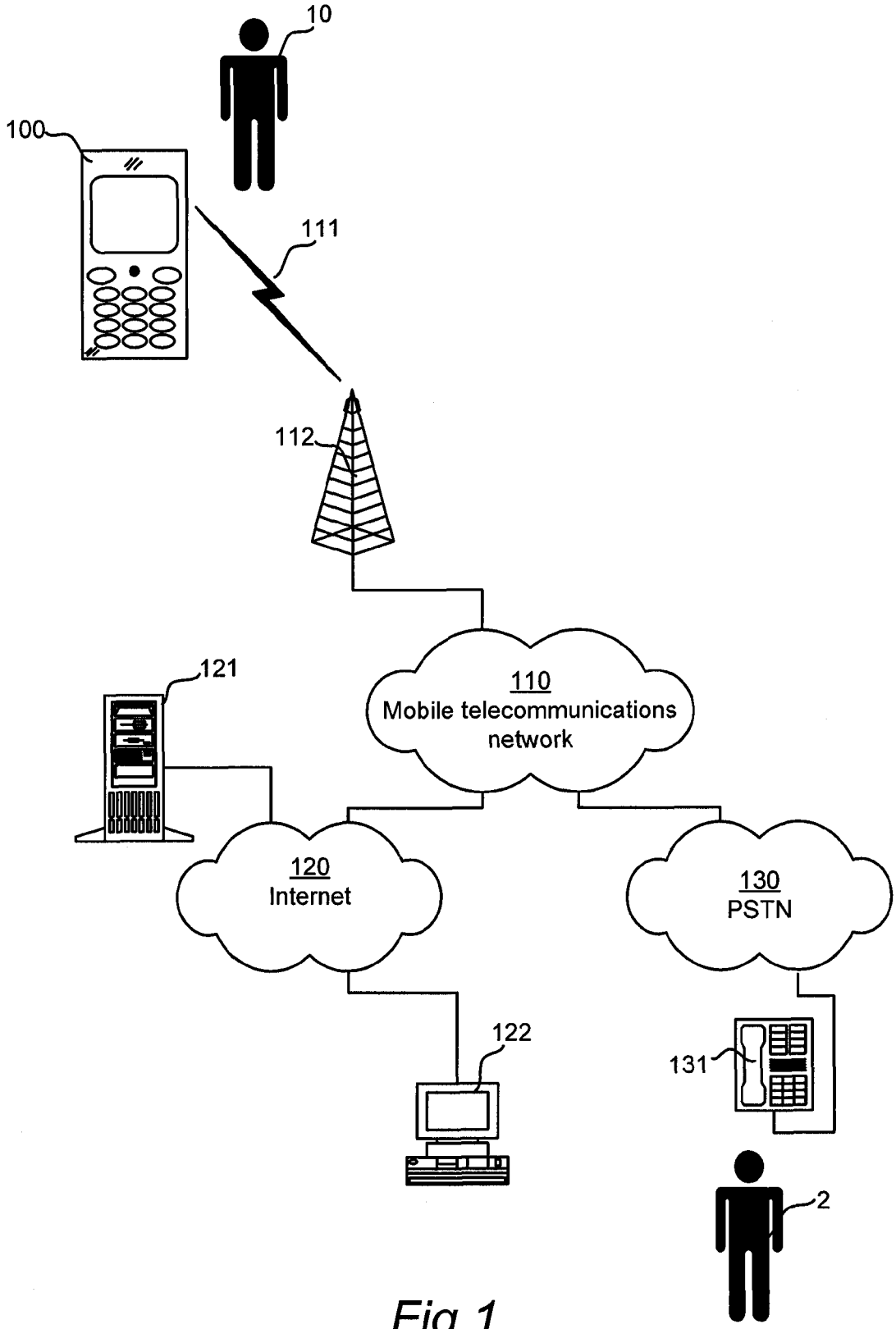
FIG. 1 is a schematic illustration of a non-limiting example of an environment in which embodiments of the present invention may be exercised, in the form of a mobile telecommunications network.

Embodiments of the invention will be now described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

Figure 2:
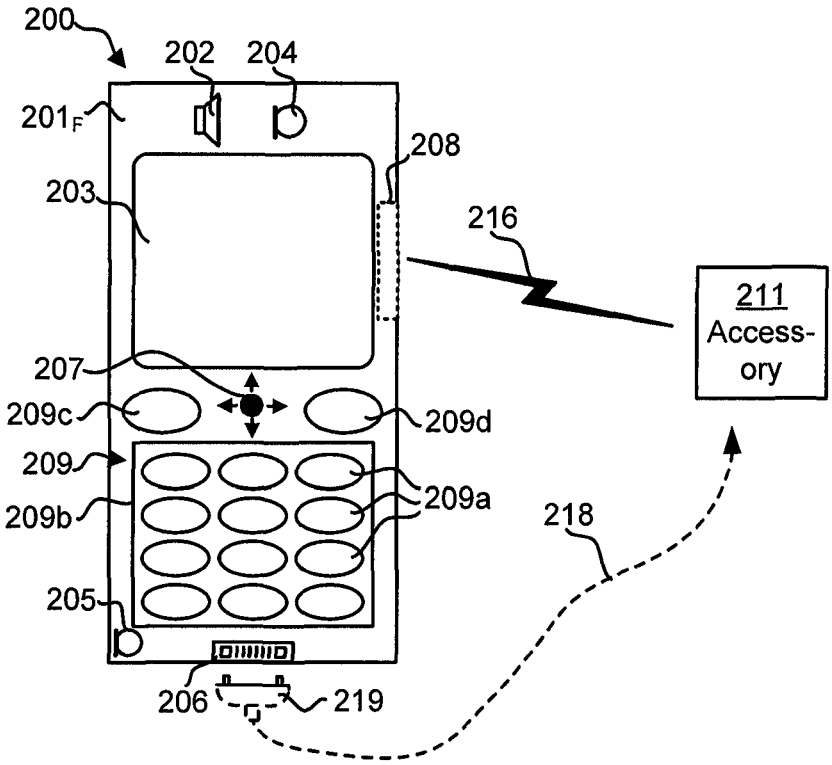
FIG. 2 is a schematic front view of a portable communication apparatus according to an embodiment of the present invention, in the form of a mobile terminal.

A sound reproducing device and an ambient noise cancellation method according to the invention may be embodied in many different forms. In one embodiment the sound reproducing device is a mobile terminal (mobile phone) which is shown in FIG. 2 and which is adapted to utilize the ambient noise cancellation method. Other embodiments include—but are not limited to—stereo headphones and public announcement speaker systems in for instance aircrafts. The invention is not limited to any particular type of sound reproducing device.

Before turning to a detailed description of automatic polarity adaption of anti-noise in different embodiments of the invention, the mobile terminal of FIG. 2 will be described together with an exemplifying environment in which it may be used, shown in FIG. 1.

Starting with FIG. 1, a sound reproducing device in the form of a mobile terminal 100 is part of a cellular telecommunications system. A user 10 of the mobile terminal 100 may conduct voice calls with other users 2 which are accessible through the cellular telecommunications system. In addition to voice calls, the user 1 may use various other telecommunications services, such as Internet browsing, video calls, data calls, facsimile transmissions, still image transmissions, video transmissions, electronic messaging, and e-commerce. None of these telecommunication services are however central within the context of the present invention; there are no limitations to any particular set of services in this respect.

The mobile terminal 100 connects to a mobile telecommunications network 110 over a radio link 111 and a base station 112. The mobile terminal 100 and the mobile telecommunications network 110 may comply with any commercially available mobile telecommunications standard, including but not limited to GSM, UMTS, D-AMPS, CDMA2000, FOMA and TD-SCDMA.

A conventional public switched telephone network (PSTN) 130 is connected to the mobile telecommunications network 110. Various telephone terminals, including a stationary telephone 131, may connect to the PSTN 130.

The mobile telecommunications network 110 is also operatively associated with a wide area data network 120, such as the Internet. Server computers 121 and client computers 122 may be connected to the wide area data network 120 and therefore allow communication with the mobile terminal 100.

An embodiment 200 of the mobile terminal 100 is illustrated in more detail in FIG. 2. The mobile terminal 200 has a housing that includes a front side $\mathbf{201}_F$. The front side $\mathbf{201}_F$ has a man-to-machine interface (MMI), or user interface, which includes a loudspeaker (a.k.a. ear speaker or earphone) 202 and a first microphone 205 positioned to pick up the voice of the user 10. In a vicinity of the loudspeaker 202, there is also provided a second microphone 204. The second microphone 204 is part of the mobile terminal's ANC system and thus serves to sense the sum of the surrounding (ambient) noise and the anti-noise (for a feed-back ANC system), or just the surrounding (ambient) noise (for a feed-forward ANC system). This will be explained in more detail in connection with FIGS. 4*a-c*.

The front side $\mathbf{201}_F$ further has a display 203 and an ITU-T-type keypad 209. The keypad 209 has twelve alpha-numeric keys 209*a* distributed within a keypad area 209*b*, wherein the keys represent the digits 0-9 and the characters * and #. Certain other special keys such as soft keys 209*c*, 209*d* may also be provided. Furthermore, the mobile terminal 200 may also have a navigational input device 207, such as a joystick, a touch pad, a rotator, a jog dial or a set of arrow keys (navigation keys). Other well-known external components may also be provided, such as power switch, battery, volume controls and external antenna, but are not indicated in FIG. 2 for the sake of brevity.

The mobile terminal 200 also has one or more machine-to-machine interface(s). In FIG. 2, there is shown a first interface 206 which can be used in a well known manner for connecting an accessory device 211, such as a charger. The first interface 206 may be a serial interface such as, for instance, Universal Serial Bus (USB). Furthermore, the mobile terminal 200 has a second interface 208 which is wireless and can be used for wireless connection of accessories, such as a portable hands-free unit, and for short-range wireless data communication. The second interface 208 may for instance be compliant with the Bluetooth™ standard, or IrDA (Infrared Data Association), WLAN (Wireless Local Area Network) or NFC (Near Field Communication).

Needless to say, the mobile terminal 200 further has an internal hardware and software structure which is commonplace in the technical field and which is therefore not referred to in detail herein. One element in this structure is a main controller which is typically implemented by a commercially available and suitably programmed CPU ("Central Processing Unit"), DSP ("Digital Signal Processor"), FPGA ("Field-Programmable Gate Array") or ASIC ("Application-Specific Integrated Circuit")).

Other elements may include display controller, I/O interface circuits, various memory devices (e.g. RAM memory, ROM memory, EEPROM memory, flash memory, hard disk, or any combination thereof), and a radio interface. The radio interface comprises an internal or external antenna as well as appropriate electronic radio circuitry for establishing and maintaining a wireless link to a base station (for instance the radio link 111 and base station 112 in FIG. 1). Such electronic radio circuitry comprises analog and digital components which constitute a radio receiver and transmitter. These components may include band pass filters, amplifiers, mixers, local oscillators, low pass filters, AD/DA converters, etc. The radio interface typically also includes associated communication service software in the form of modules, protocol stacks and drivers. In addition, the mobile terminal 200 will typically contain other software in the form of a real-time operating system and various application programs.

A detailed description of automatic polarity adaption of anti-noise in different embodiments of the invention will now be given with reference to FIGS. 4*a-c*.

Figure 3A:
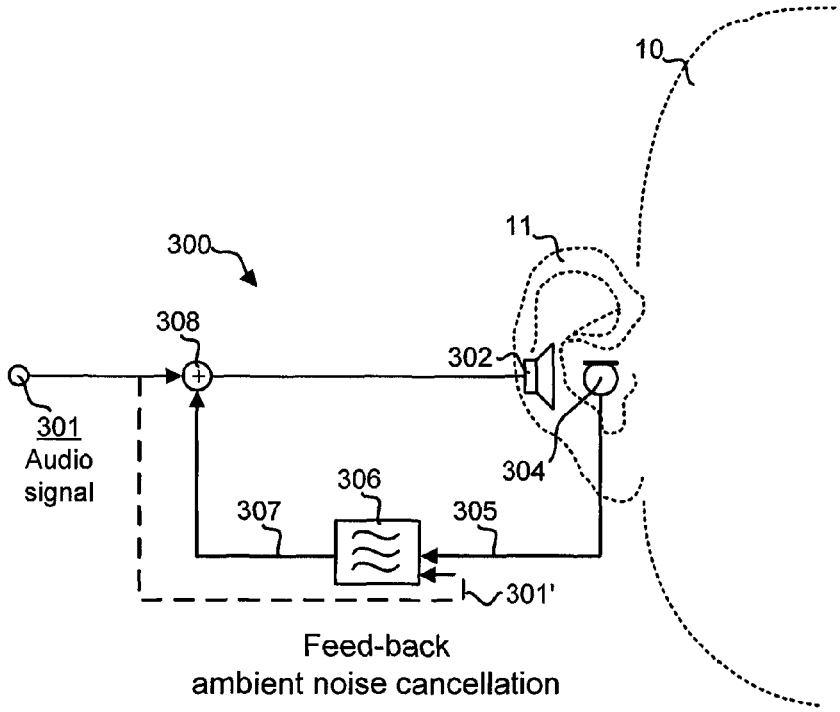
Fig 3a Prior art
FIG. 3*a* is a schematic block diagram representing ambient noise cancellation according to a first prior art approach, referred to as feed-back ambient noise cancellation.
Figure 3B:
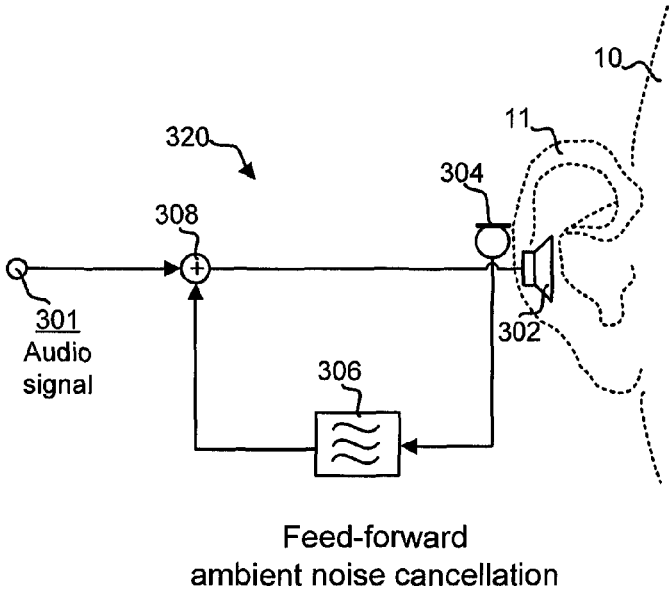
Fig 3b Prior art
FIG. 3*b* is a schematic block diagram representing ambient noise cancellation according to a second prior art approach, referred to as feed-forward ambient noise cancellation.
Figure 4A:
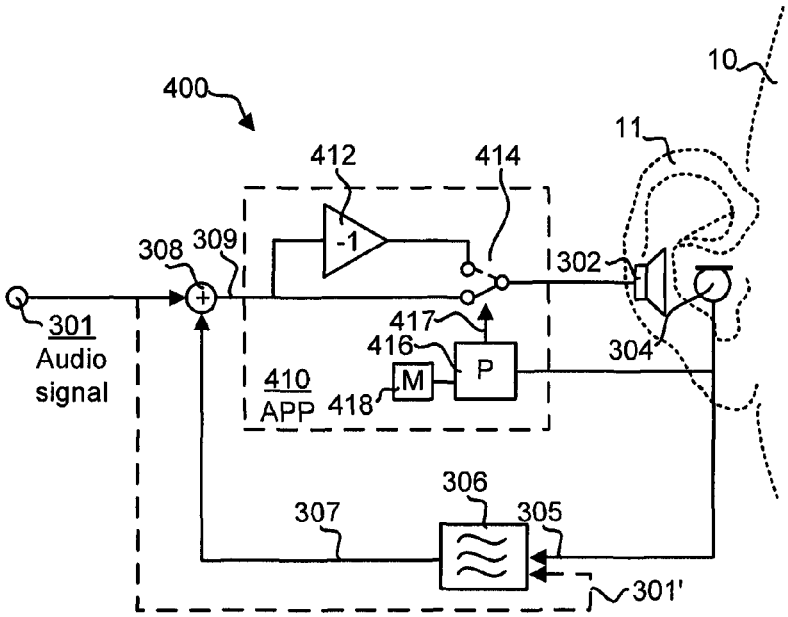
FIG. 4*a* is a schematic block diagram representing ambient noise cancellation with automatic polarity adaptation according to a first embodiment of the present invention.

FIG. 4*a* is a schematic block diagram representing ambient noise cancellation with automatic polarity adaptation according to a first embodiment of the present invention. This embodiment involves a feed-back ANC system 400. Audio signal 301, loudspeaker 302, microphone 304, microphone signal 305, signal processing means 306, anti-noise signal 307 and adder 308 all have essentially the same purpose as in the prior art system 300 of FIG. 3*a*; therefore the same reference numerals have been used. The feed-back ANC system 400 may for instance be used in the mobile terminal 200 of FIG. 2, wherein loudspeaker 302 will be represented by loudspeaker 202, and microphone 304 will be represented by the second microphone 204. Alternatively, the feed-back ANC system 400 may be used in other kinds of sound reproducing devices, as previously explained.

Thus, the loudspeaker 302 serves to produce sound from the audio signal 301 provided by an audio signal source. When the ANC system 400 is used in the mobile terminal 200 of FIG. 2, the audio signal source may be e.g. an audio codec included in an audio interface of the mobile terminal for the purpose of generating an audio voice signal 301 resulting from an ongoing voice call, or a media player application for the purpose of generating an audio music signal 301 by reading and decoding a stored or streamed mp3 file.

Figure 5:
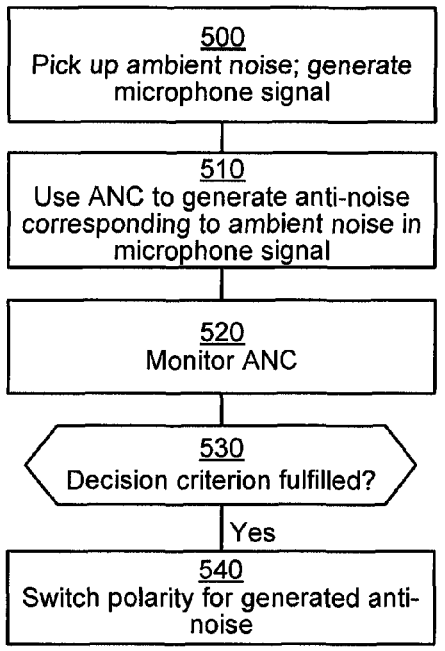
FIG. 5 is a schematic flowchart diagram of an ambient noise cancellation method with automatic polarity adaptation according to en embodiment of the present invention.

The microphone 304 is positioned to pick up ambient noise and generate the microphone signal 305 which comprises this noise. Also see step 500 in FIG. 5. More specifically, since the ANC system 400 is of feed-back type, the microphone signal 305 will contain noise contents which correspond to the sum of the ambient noise and the anti-noise produced by the ANC system 400.

The ANC system 400 is arranged to receive the microphone signal from the microphone 305. Audio signal components may be removed from the microphone signal 305, as indicated at 301' and previously explained with reference to FIG. 3*a*. The signal processing means 306 serves to generate anti-noise corresponding to the ambient noise detected by the microphone 304 (step 510 in FIG. 5). To this end, the signal processing means 306 has one or more signal filters including polarity inversion and will process the microphone signal 305 and generate the anti-noise output signal 307 in a form which will act to cancel the ambient noise. The anti-noise output signal 307 is added to the audio signal 301 in an adder 308, and the resulting signal 309 is fed to the loudspeaker 302. The feedback loop thus formed will, over time, cancel as much as possible of the ambient noise. The signal processing means 306 may for instance be implemented by a DSP, or alternatively by a CPU, FPGA, ASIC, or any other combination of digital and/or analog components capable of implementing the disclosed functionality.

In accordance with the invention, there is also provided an automatic polarity adaptation (AAP) system 410. This AAP system 410 is arranged to monitor the ANC system 400 as regards its capacity to obtain noise cancellation (step 520 in FIG. 5). This may involve monitoring the signal processing means 306 as such, or the microphone signal 305 as is the case for the embodiment in FIG. 4*a*. Further, when a decision criterion is fulfilled (step 530 in FIG. 5), the AAP system 410 is arranged to cause a switch in polarity for the generated anti-noise (step 540 in FIG. 5).

On a functional level, the elements of the AAP system 410 are shown in FIG. 4*a*. Control means 416 is arranged to read the microphone signal 305 and determine whether the noise contents thereof (the sum of the ambient noise and the generated anti-noise) behave as expected. Ideally, the generated anti-noise should cancel the ambient noise such that the resulting noise contents of the microphone signal should approach zero, except for periods when there is a sudden change in the ambient noise. Therefore, the aforementioned decision criterion of the AAP system 410 may for instance be that the sum of the ambient noise and the generated anti-noise in the microphone signal 305 exceeds a predetermined limit. The predetermined limit may be an absolute value, or a value defined relative to (an)other factor(s), such as the energy contents of the microphone signal 305 as a whole (including also the input audio signal 301. In some embodiments, the decision criterion may also include a temporal factor, such as the behavior of the resulting noise contents of the microphone signal 305 as developed over a certain time. To this end, the control means 416 may monitor the microphone signal 305 to see that its resulting noise contents converge as expected.

If it does not, the decision criterion of the AAP system 410 is fulfilled, and further functionality is triggered. This may be due to an incorrect mounting of the loudspeaker 302. In such a case, the control means 416 may issue a command or control signal 417 to a switch means 414 which will cause a switch in polarity for the generated anti-noise by enabling or switching in an inverter means 412. Thus, as seen in FIG. 4*a*, the switch means 414 is coupled to be controllable by the control means 416 and has an output coupled to the loudspeaker 302. The inverter means 412 is coupled to receive the resulting audio signal 309 and has an output coupled to an input of the switch means 414. When the decision criterion is fulfilled, by issuing the command or control signal 417 to the switch means 414, the control means 416 will enable the switch means 414 to reverse the polarity of the resulting audio signal 309 from the adder 308, and deliver it to the loudspeaker 302. Thus, the resulting audio signal 309 fed to the loudspeaker 302 will be reversed in polarity to compensate or adapt to the fact that the loudspeaker 302 has been incorrectly mounted.

In embodiments where the functionality described above occurs in the digital domain, the inverter means 412 may consist in functionality which reverses the amplitude of each sample in the digital signal 309. In such a case, analog-to-digital (ADC) and digital-to-analog (DAC) converters may also be provided at appropriate locations in the circuitry of FIG. 4*a* (for instance an ADC between 301 and 308 and between 304 and 306, and a DAC between 414 and 302). In embodiments where the functionality described above instead occurs in the analog domain, the inverter means 412 may be implemented as an inverter-coupled operational amplifier.

In the disclosed embodiment, when the control means 416 has found in step 530 that the decision criterion of the AAP system 410 is fulfilled, the control means 416 is further arranged to store information about this in a memory 418. Thus, such stored information will indicate that the loudspeaker 302 is mounted with a reversed polarity which requires a switch in polarity for the generated anti-noise in order for the ANC system 400 to work properly. This stored information in the memory 418 may be used in the future by the ANC system 400 or the AAP system 410 for affecting the generation of anti-noise, for instance the next time the sound reproducing device is powered up and therefore also the ANC system 400 is started, or when the ANC system 400 is (re-) activated for another reason. By reading and using the stored information in memory 418, the ANC system 400 or AAP system 410 may directly learn that a switch in polarity is required for the generated anti-noise, wherein the switch in polarity may take place quickly and without disturbance to the user 10. In embodiments where the ANC system 400 uses such stored information in memory 418, any of the filter parameters, or coefficients, of the signal processing means 306 may be automatically changed to achieve the desired immediate change in polarity, for instance by changing one or more start or default values thereof. In embodiments where instead the AAP system 410 uses the stored information in memory 418, the control means 416 may directly issue the command or control signal 417 to the switch 414 in order to achieve the desired immediate change in polarity.

It is to be noticed that the elements 412-418 of the AAP system 410 do not have to be separate elements on a structural or physical level. For instance, all functional elements 412-418 may be implemented as one DSP or ASIC. Alternatively, the functional elements 412-418 may be implemented by the same DSP, ASIC, etc, as the signal processing means 306 of the ANC system 400. In other words, although being described herein as a separate system, the AAP system 410 may in an actual implementation be embodied within the ANC system 400.

Figure 4B:
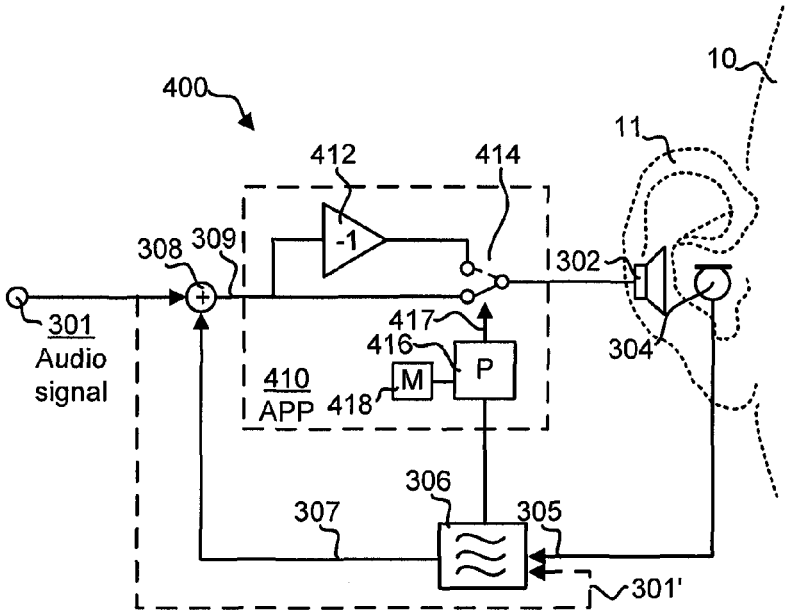
FIG. 4*b* is a schematic block diagram representing ambient noise cancellation with automatic polarity adaptation according to a second embodiment of the present invention.

FIG. 4*b* is a schematic block diagram representing ambient noise cancellation with automatic polarity adaptation according to a second embodiment of the present invention. Just like the FIG. 4*a* embodiment, the embodiment in FIG. 4*b* involves a feedback ANC system 400, and the two embodiments may be identical in all practical aspects except for the following differences. Rather than the microphone signal 305, the AAP system 410 in FIG. 4*b* is arranged to monitor the signal processing means 306 of the ANC system 400. (Alternative embodiments are also possible in which the AAP system 410 is configured to monitor both the microphone signal 305 and the signal processing means 306.) Therefore, in this embodiment, the decision criterion of the AAP system 410 relates to the behavior of the signal processing means 306 as such. In this embodiment, the signal processing means 306 involves one or more digital signal filters. During operation of the ANC system 400, a feedback loop adaptation process is performed in which filter parameters of the signal filter(s) are adapted in order to minimize the sum of the ambient noise and the generated anti-noise in the microphone signal 305. The AAP system 410 monitors this feedback loop adaptation process, particularly how the adaptation of the filter parameters develops over time, and the decision criterion defines a limit beyond which the feedback loop adaptation process is deemed not to converge as expected.

Figure 4C:
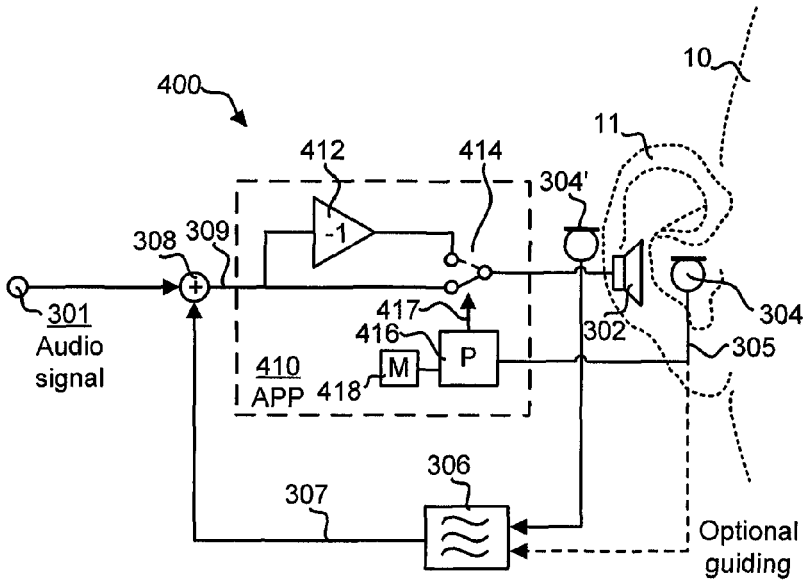
FIG. 4*c* is a schematic block diagram representing ambient noise cancellation with automatic polarity adaptation according to a third embodiment of the present invention.

FIG. 4*c* is a schematic block diagram representing ambient noise cancellation with automatic polarity adaptation according to a third embodiment of the present invention. This embodiment is different from FIGS. 4*a* and 4*b* in that it involves an ANC system 400 of feed-forward type, involving a first microphone 304' positioned outside of the ear 11 of the user 10 and therefore only picking of ambient noise. In addition, there is provided a second microphone 304 which is positioned and functions like the microphone 304 of the embodiments in FIGS. 4*a* and 4*b*, i.e. within the ear 11. Therefore, the second microphone 304 is used by the AAP system 410 which will monitor its microphone signal to determine when a switch in polarity of the generated anti-noise is required. The ANC system 400, on the other hand, does not necessarily have to use the output from the second microphone 304; it may operate as a strict feed-forward system and provide ANC based solely on the output from the first microphone 304'. Nevertheless, in the disclosed embodiment of FIG. 4*c*, there is in fact some optional coupling between the second microphone 304 and the ANC system 400. This is seen by the dashed line between microphone 304 and signal processing means 306, indicating optional guiding.

The invention has been described above with reference to some embodiments thereof. However, as is readily understood by a skilled person, other embodiments are also possible within the scope of the present invention, as defined by the appended claims.

What is claimed is:

1. A sound reproducing device having:

a loudspeaker arranged to produce sound from an audio signal provided by an audio signal source;

a microphone positioned to pick up ambient noise and generate a microphone signal comprising said noise;

an ambient noise cancellation (ANC) system arranged to receive the microphone signal from said microphone and to generate anti-noise corresponding to the ambient noise in said microphone signal; and an automatic polarity adaptation (AAP) system arranged to monitor said ANC system and, when a decision criterion is fulfilled, to cause a switch in polarity for the generated anti-noise, wherein the generated anti-noise is added to said audio signal provided by said audio signal source to form a resulting audio signal which is fed to said loudspeaker, and wherein said AAP system is arranged to cause said switch in polarity for the generated anti-noise by reversing the polarity of said resulting audio signal;

said AAP system comprising:

control means coupled to monitor said ANC system;

switch means coupled to be controllable by said control means and having an output coupled to said loudspeaker; and inverter means coupled to receive said resulting audio signal and having an output coupled to an input of said switch means, wherein the control means is arranged, when said decision criterion is fulfilled, to issue a command or control signal to said switch means to enable said switch means to reverse the polarity of said resulting audio signal and deliver it to said loudspeaker.

2. A sound reproducing device as defined in claim 1, said AAP system being arranged to monitor said ANC system by monitoring said microphone signal, wherein said decision criterion is that the sum of the ambient noise and the generated anti-noise in said microphone signal exceeds a predetermined limit.

3. A sound reproducing device as defined in claim 1, said ANC system comprising at least one signal filter and being arranged to perform a feedback loop adaptation process in which filter parameters of said signal filter are adapted in order to minimize the sum of the ambient noise and the generated anti-noise in said microphone signal, wherein said decision criterion is that the feedback loop adaptation process does not converge as expected.

4. A sound reproducing device as defined in claim 1, wherein the AAP system is further arranged, when said decision criterion is fulfilled, to store information in a memory, said stored information indicating that the loudspeaker is mounted with a reversed polarity which requires a switch in polarity for the generated anti-noise in order for said ANC system to work properly.

5. A sound reproducing device as defined in claim 4, wherein at least one of said AAP system or said ANC system is further arranged to use the information stored in said memory in the future for causing said switch in polarity based on said stored information.

6. A portable communication apparatus, comprising a sound reproducing device as defined in claim 1.

7. An ambient noise cancellation method, involving:

picking up ambient noise to generate a microphone signal;

providing ambient noise cancellation (ANC) to generate anti-noise corresponding to the ambient noise in said microphone signal;

monitoring the ambient noise cancellation;

determining that a decision criterion is fulfilled; and causing a switch in polarity for the generated anti-noise, wherein the generated anti-noise is added to an audio signal provided by an audio signal source to form a resulting audio signal which is fed to a loudspeaker, and wherein said switch in polarity for the generated anti-noise reverses the polarity of said resulting audio signal;

the causing the switch in polarity for the generated anti-noise including:

monitoring said anti-noise cancellation;

when said decision criterion is fulfilled, issuing a command or control signal to enable the reversing of the polarity of said resulting audio signal; and delivering the resulting audio signal to said loudspeaker.

* * * * *